US005492251A

United States Patent [19]

Albini et al.

[11] Patent Number: 5,492,251

[45] Date of Patent: Feb. 20, 1996

[54] PRESSURIZED LIQUID DISPENSER WITH MEMBERS FOR LOCKING IT IN ITS LOWERED POSITION

[75] Inventors: Giovanni Albini; Tommaso Ruscitti, both of Milan; Franco Carlappi, Pianello Valtidone, all of Italy

[73] Assignee: Ter S.R.L., Milan, Italy

[21] Appl. No.: 401,794

[22] Filed: Mar. 10, 1995

[30] Foreign Application Priority Data

May 27, 1994 [IT] Italy ..... MI94A1094

[51] Int. Cl.[6] ..... B67D 5/32

[52] U.S. Cl. ..... 222/153.13

[58] Field of Search ..... 222/153.13, 153.11, 222/384, 402.11, 321.1, 321.7, 321.9, 402.14

[56] References Cited

U.S. PATENT DOCUMENTS

| | | | |
|---|---|---|---|
| 4,368,830 | 1/1983 | Soughers | 222/384 X |
| 4,496,082 | 1/1985 | Corsette | 222/153.13 |
| 4,524,888 | 6/1985 | Tada | 222/153.13 X |
| 4,566,611 | 1/1986 | Sukopp | 222/153.13 |
| 5,016,780 | 5/1991 | Moretti | 222/153.13 |

FOREIGN PATENT DOCUMENTS

| | | | |
|---|---|---|---|
| 65214 | 11/1982 | European Pat. Off. | 222/153.13 |

*Primary Examiner*—Kevin P. Shaver
*Attorney, Agent, or Firm*—Oblon, Spivak, McClelland, Maier, & Neustadt

[57] ABSTRACT

A pressurized fluid dispenser is adapted to be fitted unto the stem of a fluid delivery pump. A skirt portion is flexibly connected to the remaining portion of the dispenser. A tongue projects from the skirt portion. The tongue may be pressed to flex the skirt portion inwardly. A tooth on the outer surface of the free end of the skirt portion project outwardly. The tooth is snap-engageable with an annular rib which projects into the interior of an aperture in the top of a ring cap adapted to attach the fluid delivery pump to a container mouth.

4 Claims, 1 Drawing Sheet

PRESSURIZED LIQUID DISPENSER WITH MEMBERS FOR LOCKING IT IN ITS LOWERED POSITION

BACKGROUND OF THE INVENTION

1. Field of the Invention

This invention relates to a pressurized fluid dispenser with members for locking it in its lowered position.

2. Discussion of Background

Pumps for delivering fluids (liquids or creamy substances) under pressure are of many different types and are of widespread common use. The fluid pumped by them passes through a dispenser mounted on the head of the pump, to be expelled to the outside.

As the pump plus dispenser occupies a relatively large space in its length direction, with obvious drawbacks deriving therefrom, various systems have been devised and used for locking the dispenser in its lowered position on the relative pump for storage, packaging and transport purposes, and to prevent fluid ejection if the dispenser is accidentally pressed towards the pump on which it is mounted.

This is achieved in the known art by providing engagement members between the dispenser and a ring cap which is fixed relative to the main pump body. To achieve engagement, the dispenser is lowered onto the ring cap and is then rotated relative to it, to hence achieve a stable locking position. This means that the dispenser can be moved into the engagement position only if it is in a precisely defined position relative to the ring cap. This operation is annoying enough when done manually by the pump user (before lowering and rotating the dispenser he has to correctly position it on the ring cap fixed to the mouth of the bottle on which the pump is mounted), but when done mechanically at high speed before the pump plus dispenser is put onto the market it creates very serious problems.

As the pump complete with its ring cap and dispenser is often sold already in the locked state by the producer company, the firm which purchases and uses the pump, and which has to mount and fix it onto bottles or the like containing the fluid to be dispensed, has not only the problem of mechanically gripping the ring cap plus dispenser, which are locked together in a rigid position (in particular if the dispenser is for creams or the like, ie is provided with a laterally projecting elongate spout), but also, and in particular, the serious problem of mounting the ring cap in a well defined position on the bottle with the dispenser locked but orientated in the correct direction relative to the body of the bottle when this is of irregular shape. For example, if the bottle is flat and the dispenser has to dispense liquid soap or a cream through the elongate spout, the pump must be fixed on the bottle mouth with said spout locked but pointing in the direction of the maximum bottle width (to allow easy storage and boxing), this being certainly not simple to achieve when operating with high speed automatic machines.

SUMMARY OF THE INVENTION

The main object of the present invention is to provide a dispenser which can be fixed in its lowered position onto a fixing ring cap or the like, irrespective of the position of the dispenser relative to the ring cap.

A further object is to provide a dispenser with means for its fixing onto the respective ring cap, which enable the thus fixed dispenser to be freely rotated about the ring cap, so that it can be mechanically handled and mounted at high speed onto any bottle or the like.

These and further objects are attained by a dispenser comprising a manually operable head traversed by a discharge hole communicating with a seat for its housing on the free end of the stem of a pressurized fluid delivery pump, a ring cap connected to said pump, and members for engaging said head and removably retaining it in its lowered position on said ring cap, characterised in that from said head there projects about the seat provided therein a skirt extending towards a substantially circular aperture in said ring cap, said skirt being insertable into and translatable and freely rotatable within said aperture, in said skirt there being provided two longitudinal cuts delimiting a skirt portion which is hence connected to the remaining part of the head in a manner flexible to it, from the outer surface of said skirt portion in proximity to its free end there projecting at least one tooth snap-engagable with said ring cap at that edge thereof delimiting said aperture.

Preferably said skirt is cylindrical and coaxial with said circular aperture in the ring cap, from said skirt portion there projecting outwards a tongue operable by one finger to cause it to rock on said flexible appendix and hence release from the ring cap the tooth projecting from it.

The structure and operation of the lockable dispenser according to the present invention will be more apparent from the description of one embodiment thereof given hereinafter by way of non-limiting embodiment with reference to the accompanying drawing, in which:

DESCRIPTION OF THE PREFERRED EMBODIMENTS

Figure 1:
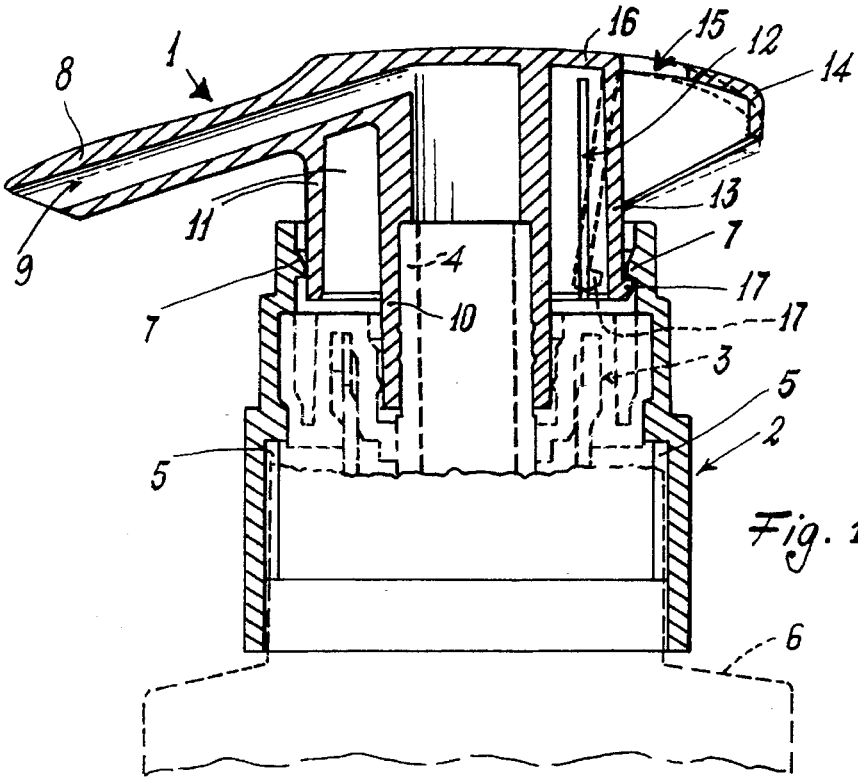
FIG. 1 is a longitudinal section through the dispenser in the locked position.

As can be seen from the drawings, the dispenser comprises a head 1 and a ring cap 2 which mutually cooperate.

The ring cap 2 can be fixed to a mechanical pump 3 (shown schematically on the drawings) of any known type and having (as in the case of all such pumps) a hollow stem 4 through which the pressurized fluid delivered by the pump emerges. In the illustrated embodiment, the ring cap is provided with a thread 5 by which it can be fixed onto the threaded mouth of a bottle or container 6 on which the pump 3 is fitted. In the top (with respect to the figures) of the ring cap 2 there is provided an aperture into which an annular rib 7 projects.

The dispenser head 1 comprises an elongate spout 8 with a discharge hole which via a duct 9 communicates with a seat delimited by a wall 10 and into which the upper end of the pump stem 4 can be inserted and be retained, as shown in FIG. 1.

The head 1 comprises a cylindrical skirt 11 extending towards the ring cap 2 and coaxial with the rib 7, said skirt 11 being insertable into and translatable and rotatable within the space defined by the rib.

Within the skirt there are provided two longitudinal cuts 12 delimiting a skirt portion 13 to which an outwardly projecting tongue 14 is rigidly connected.

The skirt portion 13 with its tongue 14 are connected to the remaining part of the head in a manner flexible to it.

To favor this flexibility, in the top of the head there is provided an elongate hole 15 which, together with the two cuts 12, delimits two flexible appendices 16 on which the skirt portion 13 can rock.

Figure 3:
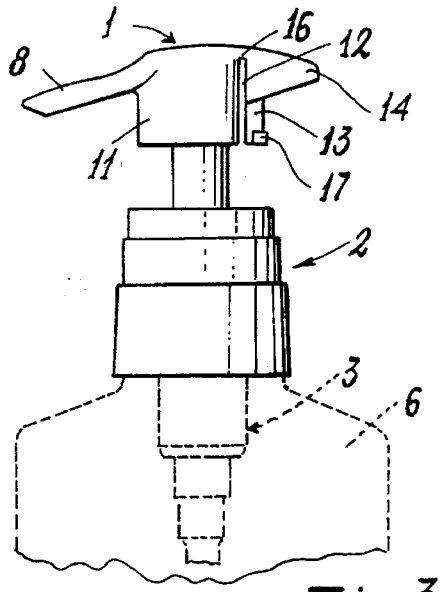
Figure 4:
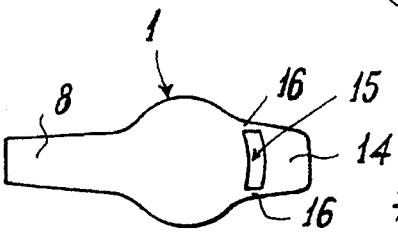
FIG. 4 is a simplified view of the dispenser head from above.

Finally it can be seen that an engagement tooth 17 projects from the outer surface in proximity to the free end of the skirt portion 13. When the head 1 is pressed totally downwards from its released position in which the pump can be operated (FIG. 3), the tooth 17 firstly interferes with the rib 7 to cause the skirt portion 13 to flex inwards, until the tooth snaps below the rib 7 (FIG. 1) to engage it securely and retain the head 1 anchored to the ring cap 2 in its lowered position (with respect to the drawing).

Figure 2:
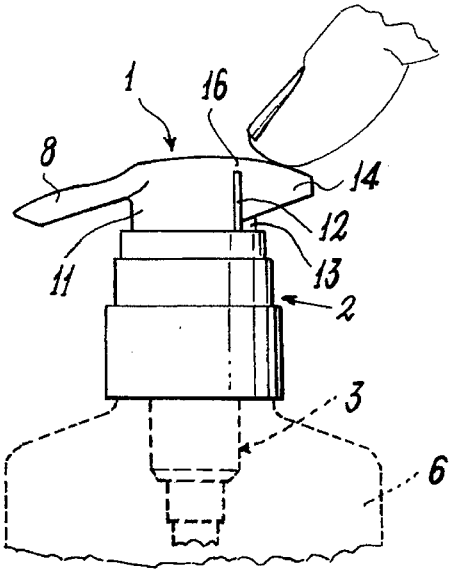
FIGS 2 and 3 are very schematic side views of the dispenser in the locked and released position respectively.

Assuming the position to be that shown in FIG. 1, the tongue 14 is pressed with a finger (FIG. 2) to flex the skirt portion 13 inwards, with the result that the tooth 17 disengages from the rib 7 and the head 1 is returned to its raised or free operating position (FIG. 3) by the spring (not shown on the drawings) present in the pump 3 and which urges the stem 4 upwards.

It is important to note two fundamental characteristics of the described dispenser, namely that the head 1 can be moved from its free operation position (FIG. 3) to its locked position (FIG. 1) by simply pushing the head totally downwards onto the ring cap 2 whatever the relative position between the head and ring cap, and that when thus anchored in its lowered position the head can be freely rotated relative to the ring cap. This is of determining importance in enabling said locking to be achieved using very simple automatic machines operating at high speed and enabling the dispenser to be mounted in the locked position on the mouth of containers or bottles of any shape, as the head can be freely orientated relative to its anchoring ring cap.

What is claimed as new and desired to be secured by Letters Patent of the United States is:

1. A pressurized fluid dispenser, comprising a manually operable head including a housing provided with a fluid discharge hole, said housing including a seat defining an opening for receiving a hollow stem of a pressurized fluid delivery pump; a duct communicating said opening defined by said seat with said discharge hole; a ring cap for attachment to the hollow stem and to a container, said ring cap including a top which defines a substantially circular aperture with an inwardly projecting rib; said housing further comprising a skirt which projects downwardly about said seat, said skirt being insertable into said circular aperture in said ring cap and translatable from a raised position where said skirt is completely above the top of said ring cap to a lowered position wherein said skirt is partially within said ring cap, said skirt being freely rotatable within said circular aperture in said ring cap, a pair of longitudinal cuts in said skirt delimiting a skirt portion having one end which is flexibly attached to the remainder of said housing, said skirt portion having a free end with an outwardly projecting tooth, said tooth being snap-engageable with said inwardly projecting rib on said ring cap for locking said skirt and associated housing in said lowered position.

2. A dispenser as claimed in claim 1, characterised in that said skirt is substantially cylindrical and is coaxial with the circular aperture in the ring cap.

3. A dispenser as claimed in claim 1, characterized in that said skirt portion includes an outwardly projecting tongue which may be pressed to force said skirt portion to flex inwardly and release said tooth from said rib on said ring cap.

4. A dispenser as claimed in claim 2, characterized in that said skirt portion includes an outwardly projecting tongue which may be pressed to force said skirt portion to flex inwardly and release said tooth from said rib on said ring cap.

* * * * *